US006293356B1

(12) United States Patent
King et al.

(10) Patent No.: US 6,293,356 B1
(45) **Date of Patent: *Sep. 25, 2001**

(54) METHOD OF AND SYSTEM FOR OPTIMIZING RATE OF PENETRATION IN DRILLING OPERATIONS

(75) Inventors: Charles H. King; Mitchell D. Pinckard, both of Houston, TX (US)

(73) Assignee: Noble Drilling Services, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/398,674

(22) Filed: Sep. 17, 1999

Related U.S. Application Data

(63) Continuation of application No. 09/053,955, filed on Apr. 2, 1998, now Pat. No. 6,026,912.

(51) Int. Cl.[7] ..... E21B 7/00
(52) U.S. Cl. ..... 175/27; 175/57; 175/94
(58) Field of Search ..... 175/24, 40, 27, 175/57, 94, 137

(56) References Cited

U.S. PATENT DOCUMENTS 2,688,871 * 9/1954 Lubinski ..... 73/151.5
3,777,560 * 12/1973 Guignard ..... 73/151.5
3,802,259 * 4/1974 Eckels ..... 73/153
3,872,932 * 3/1975 Gosselin ..... 175/26 X
3,881,695 * 5/1975 Joubert ..... 254/172
3,882,474 * 5/1975 Cain ..... 340/177
4,354,233 * 10/1982 Zhukovsky ..... 364/420
4,535,972 * 8/1985 Millheim et al. ..... 254/277
4,736,297 * 4/1988 Lejeune ..... 364/420
4,793,421 * 12/1988 Jasinski ..... 175/27
4,843,875 * 7/1989 Kerbart ..... 73/151.5
4,875,530 * 10/1989 Frink et al. ..... 175/27
4,876,886 * 10/1989 Bible et al. ..... 73/151.5
4,886,129 * 12/1989 Bourdon ..... 175/40
5,398,546 * 3/1995 Jeffryes ..... 73/151.5
5,449,047 * 9/1995 Schivley ..... 175/27
5,458,207 * 10/1995 Mattero ..... 175/27
5,474,142 * 12/1995 Bowden ..... 175/27
5,551,286 * 9/1996 Booer ..... 73/152.45
5,713,422 2/1998 Dhindsa .
5,730,234 * 3/1998 Putot ..... 175/50
6,026,912 * 2/2000 King et al. ..... 175/27

* cited by examiner

*Primary Examiner*—Roger Schoeppel
(74) *Attorney, Agent, or Firm*—Pillsbury Madison & Sutro, LLP

(57) ABSTRACT

A method of and system for optimizing bit rate of penetration while drilling substantially continuously determine an optimum weight on bit necessary to achieve an optimum bit rate of penetration based upon measured conditions and maintains weight on bit at the optimum weight on bit. As measured conditions change while drilling, the method updates the determination of optimum weight on bit.

27 Claims, 5 Drawing Sheets

FIG. 4
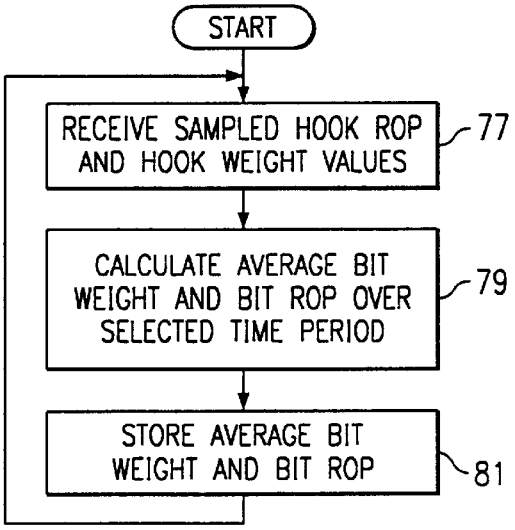
FIG. 5
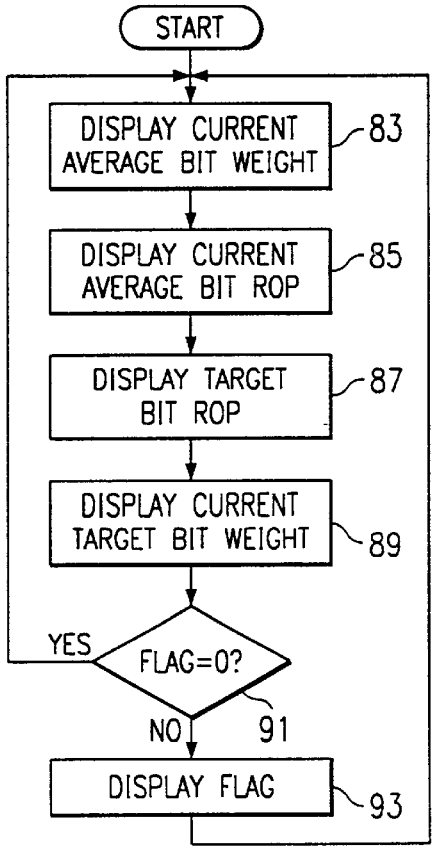
| 99 t | 101 BIT_WT(t) | 103 BIT_ROP(t) | 105 BIT_ROP(t−1) | 107 BIT_ROP(t−2) |
|---|---|---|---|---|
| 1 | 28 | 45 | – | – |
| 2 | 27 | 46 | 45 | – |
| 3 | 24 | 48 | 46 | 45 |
| 4 | 23 | 47 | 48 | 46 |
| 5 | 29 | 45 | 47 | 48 |
| 6 | 28 | 46 | 45 | 47 |
| 7 | 26 | 49 | 46 | 45 |
| 8 | 24 | 48 | 49 | 46 |
| 9 | 23 | 47 | 48 | 49 |
FIG. 8

METHOD OF AND SYSTEM FOR OPTIMIZING RATE OF PENETRATION IN DRILLING OPERATIONS

CROSS-REFERENCE TO RELATED APPLICATION

The present application is a Continuation of application Ser. No. 09/053,955, filed Apr. 2, 1998 now U.S. Pat. No. 6,026,912, titled METHOD OF AND SYSTEM FOR OPTIMIZING RATE OF PENETRATION IN DRILLING OPERATIONS.

FIELD OF THE INVENTION

The present invention relates generally to earth boring and drilling, and more particularly to a method of and system for optimizing the rate of penetration in drilling operations.

DESCRIPTION OF THE PRIOR ART

It is very expensive to drill bore holes in the earth such as those made in connection with oil and gas wells. Oil and gas bearing formations are typically located thousands of feet below the surface of the earth. Accordingly, thousands of feet of rock must be drilled through in order to reach the producing formations.

The cost of drilling a well is primarily time dependent. Accordingly, the faster the desired penetration depth is achieved, the lower the cost in completing the well.

While many operations are required to drill and complete a well, perhaps the most important is the actual drilling of the bore hole. In order to achieve the optimum time of completion of a well, it is necessary to drill at the optimum rate of penetration. Rate of penetration depends on many factors, but a primary factor is weight on bit. As disclosed, for example in Millheim, et al., U.S. Pat. No. 4,535,972, rate of penetration increases with increasing weight on bit until a certain weight on bit is reached and then decreases with further weight on bit. Thus, there is generally a particular weight on bit that will achieve a maximum rate of penetration.

Drill bit manufacturers provide information with their bits on the recommended optimum weight on bit. However, the rate of penetration depends on many factors in addition to weight on bit. For example, the rate of penetration depends upon characteristics of the formation being drilled, the speed of rotation of the drill bit, and the rate of flow of the drilling fluid. Because of the complex nature of drilling, a weight on bit that is optimum for one set of conditions may not be optimum for another set of conditions.

One method for determining an optimum rate of penetration for a particular set of conditions is known as the "drill off test", disclosed, for example, in Bourdon, U.S. Pat. No. 4,886,129. In a drill off test, an amount of weight greater than the expected optimum weight on bit is applied to the bit. As the drill string is lowered into the borehole, the entire weight of the drill string is supported by the hook. The drill string is somewhat elastic and it stretches under its own weight. When the bit contacts the bottom of the borehole, weight is transferred from the hook to the bit and the amount of drill string stretch is reduced. While holding the drill string against vertical motion at the surface, the drill bit is rotated at the desired rotation rate and with the fluid pumps at the desired pressure. As the bit is rotated, the bit penetrates the formation. Since the drill string is held against vertical motion at the surface, weight is transfer from the bit to the hook as the bit penetrates the formation. By the application of Hooke's law, as disclosed in Lubinsky U.S. Pat. No. 2,688,871, the instantaneous rate of penetration may be calculated from the instantaneous rate of change of weight on bit. By plotting bit rate of penetration against weight on bit during the drill off test, the optimum weight on bit can be determined. After the drill off test, the driller attempts to maintain the weight on bit at that optimum value.

A problem with using a drill off test to determine an optimum weight on bit is that the drill off test produces a static weight on bit value that is valid only for the particular set of conditions experienced during the test. Drilling conditions are complex and dynamic. Over the course of time, conditions change. As conditions change, the weight on bit determined in the drill off test may no longer be optimum.

It is therefore an object of the present invention to provide a method and system for determining dynamically and in real time an optimum weight on bit to achieve an optimum rate of penetration for a particular set of conditions.

SUMMARY OF THE INVENTION

The present invention provides a method of and system for optimizing bit rate of penetration while drilling. The method of the present invention substantially continuously determines an optimum weight on bit necessary to achieve an optimum bit rate of penetration for the current drilling environment and maintains weight on bit at the optimum weight on bit. As the drilling environment changes while drilling, the method updates the determination of optimum weight on bit.

The method of the present invention determines the optimum weight on bit to achieve the optimum bit rate of penetration by building a mathematical model of bit rate of penetration as a function of weight on bit. As long as actual bit rates of penetration fit the mathematical model, the mathematical model validly represents the conditions. Whenever the actual bit rates of penetration do not fit the model, conditions have changed. When the method detects a change in conditions, the method fetches an updated mathematical model and computes an updated optimum weight on bit based upon the updated mathematical model.

In one of its aspects, the method of the present invention maintains the weight on bit at the optimum by displaying a currently determined weight on bit and the optimum weight on bit to a human driller. The human driller maintains optimum weight on bit by matching the displayed currently determined weight on bit to the displayed optimum weight on bit. In another of its aspects, the method of the present invention maintains optimum weight on bit by inputting the currently determined weight on bit and the optimum weight on bit to an automatic drilling machine.

BRIEF DESCRIPTION OF THE DRAWINGS

FIG. 4 is a flowchart of data collection and generation according to the present invention.

FIG. 5 is a flowchart of display processing according to the present invention.

FIG. 8 is a data array according to the present invention.

DESCRIPTION OF THE PREFERRED EMBODIMENT

Figure 1:
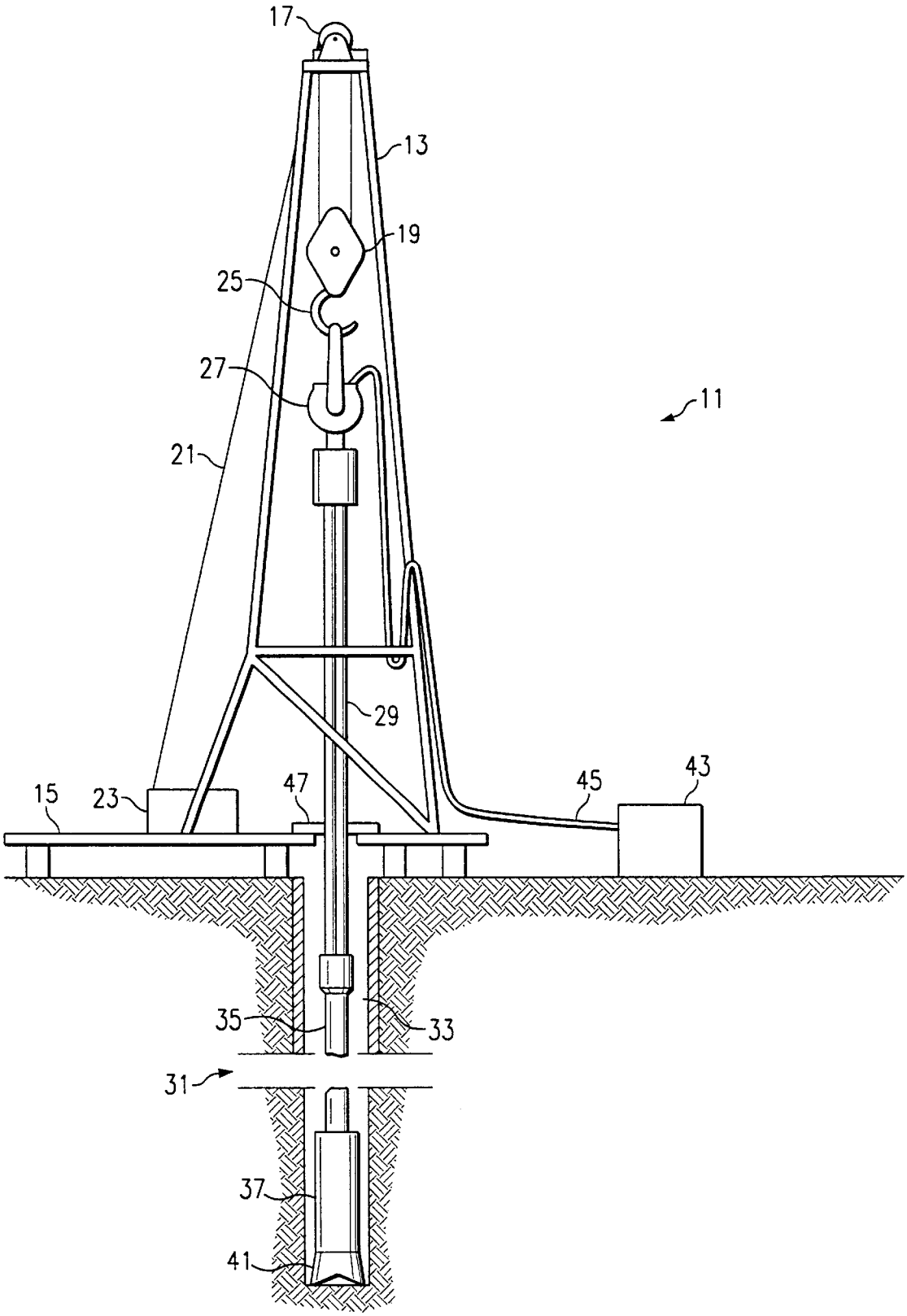
FIG. 1 is a pictorial illustration of a rotary drilling rig.

Referring now to the drawings and first to FIG. 1, a drilling rig is designated generally by the numeral 11. Rig 11 in FIG. 1 is depicted as a land rig. However, as will be apparent to those skilled in the art, the method and system of the present invention will find equal application to non-land rigs, such as jack-up rigs, semisubmersibles, drill ships, and the like. Also, although a conventional rotary rig is illustrated, those skilled in the art will recognize that the present invention is also applicable to other drilling technologies, such as top drive, power swivel, downhole motor, coiled tubing units, and the like.

Rig 11 includes a mast 13 that is supported on the ground above a rig floor 15. Rig 11 includes lifting gear, which includes a crown block 17 mounted to mast 13 and a traveling block 19. Crown block 17 and traveling block 19 are interconnected by a cable 21 that is driven by draw works 23 to control the upward and downward movement of traveling block 19. Traveling block 19 carries a hook 25 from which is suspended a swivel 27. Swivel 27 supports a kelly 29, which in turn supports a drill string, designated generally by the numeral 31 in a well bore 33. Drill string 31 includes a plurality of interconnected sections of drill pipe 35 a bottom hole assembly (BHA) 37, which includes stabilizers, drill collars, measurement while drilling (MWD) instruments, and the like. A rotary drill bit 41 is connected to the bottom of BHA 37.

Drilling fluid is delivered to drill string 31 by mud pumps 43 through a mud hose 45 connected to swivel 27. Drill string 31 is rotated within bore hole 33 by the action of a rotary table 47 rotatably supported on rig floor 15 and in nonrotating engagement with kelly 29.

Drilling is accomplished by applying weight to bit 41 and rotating drill string 31 with kelly 29 and rotary table 47. The cuttings produced as bit 41 drills into the earth are carried out of bore hole 33 by drilling mud supplied by mud pumps 43.

As is well known to those skilled in the art, the weight of drill string 31 is substantially greater than the optimum weight on bit for drilling. Accordingly, during drilling, drill string 31 is maintained in tension over most of its length above BHA 37. The weight on bit is equal to the weight of string 31 in the drilling mud less the weight suspended by hook 25.

Figure 2:
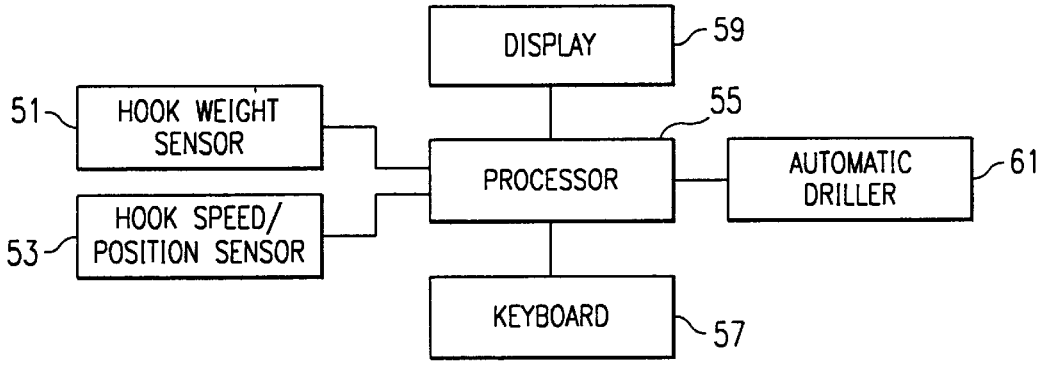
FIG. 2 is a block diagram of a system according to the present invention.

Referring now to FIG. 2, there is shown a block diagram of a preferred system of the present invention. The system includes a hook weight sensor 51. Hook weight sensors are well known in the art. They comprise digital strain gauges or the like, that produce a digital weight value at a convenient sampling rate, which in the preferred embodiment is five times per second although other sampling rates may be used. Typically, a hook weight sensor is mounted to the static line (not shown) of cable 21 of FIG. 1.

The weight on bit can be calculated by means of the hook weight sensor. As drill string 31 is lowered into the hole prior to contact of bit 41 with the bottom of the hole, the weight on the hook, as measured by the hook weight sensor, is equal to the weight of string 31 in the drilling mud. Drill string 31 is somewhat elastic. Thus, drill string 31 stretches under its own weight as it is suspended in well bore 33. When bit 41 contacts the bottom of bore hole 33, the stretch is reduced and weight is transferred from hook 25 to bit 41.

The driller applies weight to bit 41 effectively by controlling the height or position of hook 25 in mast 13. The driller controls the position of hook 25 by operating a brake to control the paying out cable from drawworks 23. Referring to FIG. 2, the system of the present invention includes a hook speed/position sensor 53. Hook speed sensors are well known to those skilled in the art. An example of a hook speed sensor is a rotation sensor coupled to crown block 17. A rotation sensor produces a digital indication of the magnitude and direction of rotation of crown block 17 at the desired sampling rate. The direction and linear travel of cable 21 can be calculated from the output of the hook position sensor. The speed of travel and position of traveling block 19 and hook 25 can be easily calculated based upon the linear speed of cable 21 and the number of cables between crown block 17 and traveling block 19.

In the manner well known to those skilled in the art, the rate of penetration (ROP) of bit 41 may be computed based upon the rate of travel of hook 25 and the time rate of change of the hook weight. Specifically, BIT_ROP=HOOK_ROP+$\Lambda$(dF/dT), where BIT_ROP represents the instantaneous rate of penetration of the bit, HOOK_ROP represents the instantaneous speed of hook 25. $\Lambda$ represents the apparent rigidity of drill string 31, and dF/dT represents the first derivative with respect to time of the weight on the hook.

In FIG. 2, each sensor 51 and 53 produces a digital output at the desired sampling rate that is received at a processor 55. Processor 55 is programmed according to the present invention to process data received from sensors 51 and 53. Processor 55 receives user input from user input devices, such as a keyboard 57. Other user input devices such as touch screens, keypads, and the like may also be used. Processor 55 provides visual output to a display 59. Processor 55 may also provide output to an automatic driller 61, as will be explained in detail hereinafter.

Figure 3:
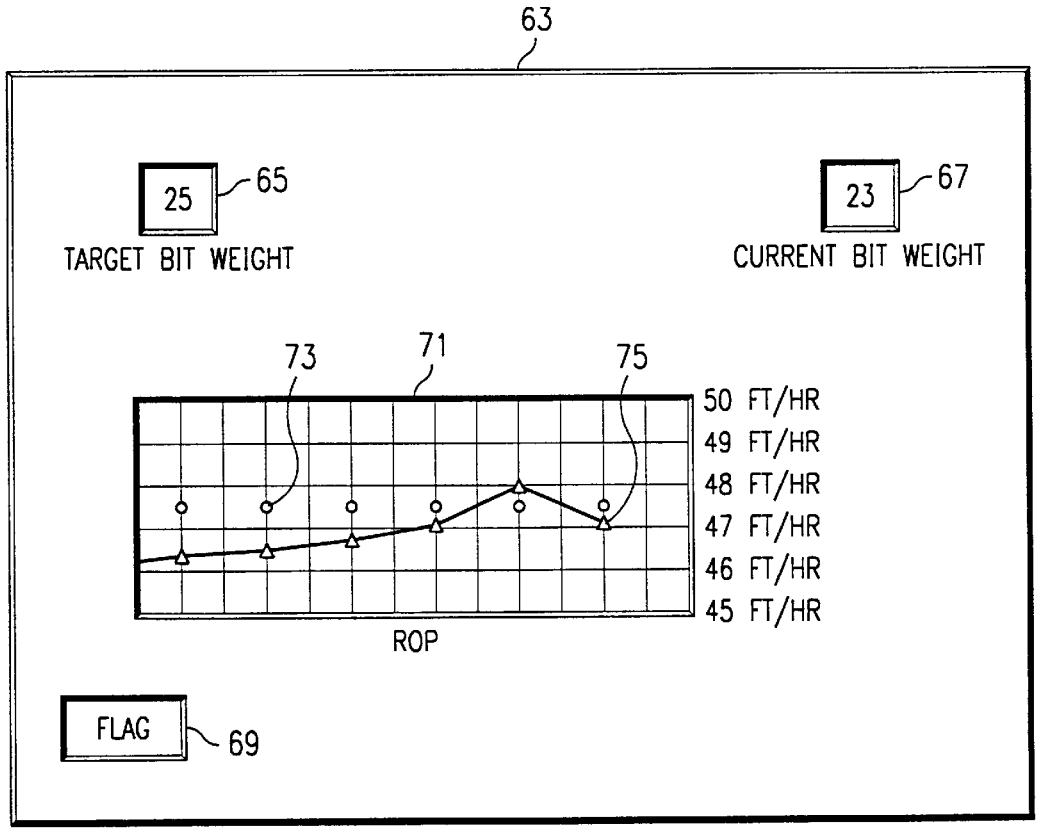
FIG. 3 is an illustration of a screen display according to the present invention.

Referring now to FIG. 3, a display screen according to the present invention is designated by the numeral 63. Display screen 63 includes a target bit weight display 65 and a current bit weight display 67. According to the present invention, a target bit weight in kilopounds is calculated to achieve a desired rate of penetration. Target bit weight display 65 displays the target bit weight computed according to the present invention. Current bit weight display 67 displays the actual current bit weight in kilopounds.

As will be explained in detail hereinafter, the method and system of the present invention constructs a mathematical model of the relationship between bit weight and rate of penetration for the current drilling environment. The mathematical model is built from data obtained from hook weight sensor 51 and hook speed/position sensor 53. When a statistically valid model is created, the present invention calculates a target bit weight, which is displayed in target bit weight display 65. After the system of the present invention has built the model, the system continually tests the validity of the model against the data obtained from hook weight sensor 51 and hook speed/position sensor 53. The system of the present invention continuously updates the model; however, the system of the present invention uses one model as long as the model is valid. If conditions change such that the current model is no longer valid, then the system of the present invention fetches the current updated model.

According to one aspect of the present invention, a driller attempts to match the value displayed in current bit weight display 67 with the value displayed in target bit weight display 65. According to another aspect of the present invention, the driller may turn control over to automatic driller 61. If the driller has turned control over to automatic driller 61, the driller continues to monitor display 63. If the model becomes invalid, then a flag 69 will be displayed.

Flag 69 indicates that the model does not match the current drilling environment. Accordingly, flag 69 indicates that the drilling environment has changed. The change may be a normal lithological transition from one rock type to another or the change may indicate an emergency or potentially catastrophic condition. When flag 69 is displayed, the driller is alerted to the change in conditions.

Display screen 63 also displays a moving plot 71 of rate of penetration. The target rate of penetration is indicated in plot 71 by circles 73 and the actual rate of penetration is indicated by triangles 75. By matching actual bit weight to target bit weight, the plot of actual rate of penetration, indicated by triangles 75, will be closely matched with the plot of target rate of penetration, indicated by circles 73, as long as the mathematical model is valid.

Referring now to FIGS. 4–7, there are shown flow charts of processing according to the present invention. In the preferred embodiment, four separate processes run in a multitasking environment. Referring to FIG. 4, there is shown a flow chart of the data collection and generation process of the present invention. The system receives sampled hook rate of penetration (ROP) and hook weight values from sensors 51 and 53, at block 77. The preferred sampling rate for hook ROP and hook weight is five times per second. The system calculates average bit weight and BIT_ROP over a selected time period, which in the preferred embodiment is ten seconds, at block 79. Then, the system stores the average bit weight and bit ROP with a time value, at block 81 and returns to block 77. Referring now to FIG. 5, there is shown display processing according to the present invention. The system displays the current average bit weight, which is calculated at block 79 of FIG. 4, at block 83. The system displays the current average bit ROP, which is also calculated at block 79 of FIG. 4, at block 85. The system displays a target bit ROP at block 87. The target bit ROP is based upon what has been observed and upon what is feasible under the applicable conditions. The system displays the current target bit weight at block 89. Current target bit weight is either a default value or a calculated value, the calculation of which will be explained in detail hereinafter.

The system tests, at decision block 91, if a flag is set to zero. As will be described in detail hereinafter, the flag is set to one whenever an observed bit rate of penetration does not fit the model. If, at decision block 91, the flag is not equal to zero, then the system displays the flag (flag 69 of FIG. 3) at block 93, and processing continues at block 83. If, at decision block 91, the flag is set to zero, then display processing returns to block 83.

Figure 6:
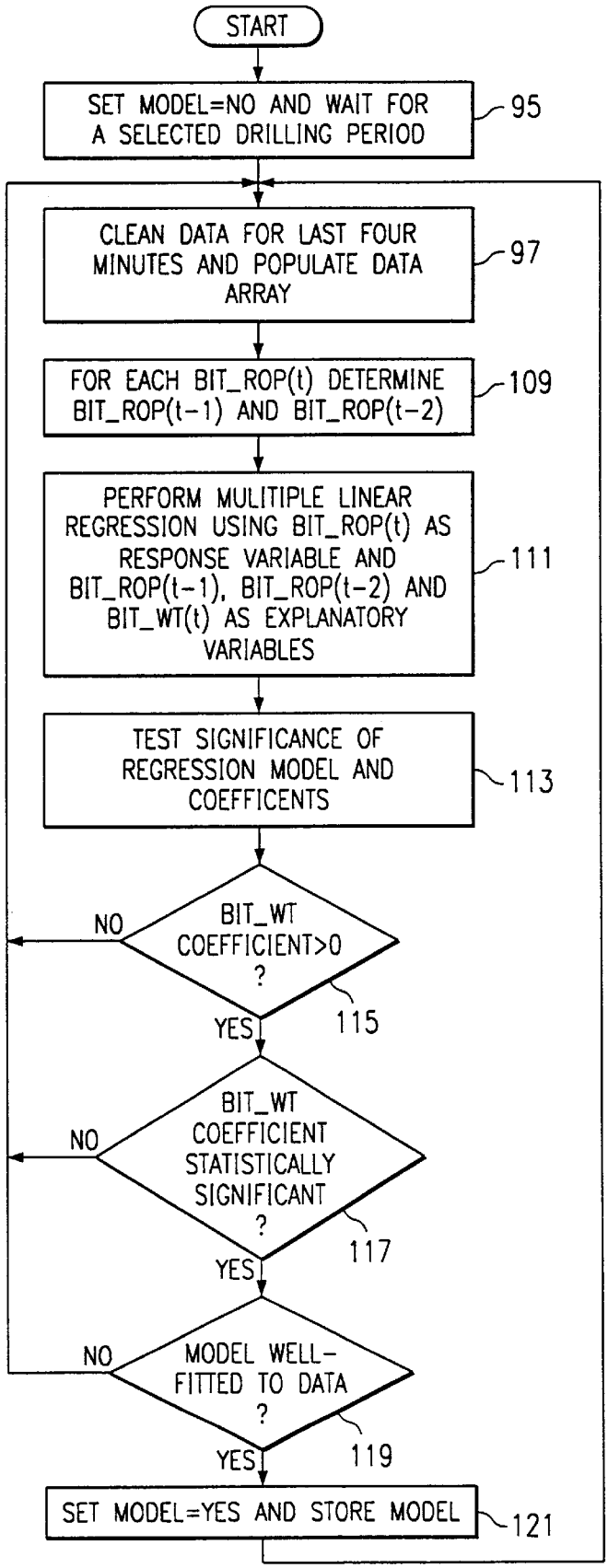
FIG. 6 is a flowchart of drilling model processing according to the present invention.

Referring now to FIG. 6, there is shown a flow chart of the building of a drilling model according to the present invention. Initially, the system sets model equal to "no" and waits a selected drilling period, which in the preferred embodiment is four minutes, at block 95. a selected drilling period. The model is based upon the observed drilling environment. During the selected drilling period, the system collects bit ROP and bit weight data. After waiting the selected drilling period, the system cleans the data for the last four minutes of drilling, at block 97. Data cleaning involves removing zeros and outliers from the data. The clean data are stored in a data array as illustrated in FIG. 8.

Referring to FIG. 8, the data array includes a time column 99, a bit weight column 101, and a bit ROP column 103. Columns 99–103 are populated with data from data cleaning step 97. The data array of FIG. 8 also includes a first lagged bit ROP column 105 and a second lagged bit ROP column 107.

Referring again to FIG. 6, after the data array is populated with clean data, at block 97, the system determines for each BIT_ROP(t) of the data array, lagged bit rate of penetration BIT_ROP(t-1) and BIT_ROP(t-2), at block 109, and populates columns 105 and 107 of the data array of FIG. 8 with the lagged values. Then, the system performs multilinear regression analysis using BIT_ROP(t) as the response variable and BIT_ROP(t-1), BIT_ROP(t-2) and BIT_WT(t) as the explanatory variables, at block 111. Multiple linear regression is a well known technique and tools for performing multilinear regression are provided in commercially available spreadsheet programs, such as Microsoft® Excel® and Corel® Quattro Pro®. Multiple linear regression produces the mathematical model of the drilling environment, which is an equation of the form:

$$(1)\ \mathrm{BIT_ROP}(t)=\alpha+\beta_1\mathrm{BIT_ROP}(t-1)+\beta_2\mathrm{BIT_ROP}(t-2)+\beta_3\mathrm{BIT_WT}(t),$$

where $\alpha$ is the intercept, $\beta_1$ and $\beta_2$ are lagged BIT_ROP coefficients and $\beta_3$ is the BIT_WT coefficient.

After the system has performed multilinear regression at block 111, the system tests the significance of the regression model and coefficients, at block 113. The system tests the significance of the regression model and coefficients by determining if the bit weight coefficient $\beta_3$ is greater than zero, at decision block 115, if the bit weight coefficient $\beta_3$ is statistically significant, at decision block 117, and if the model is well-fitted to the data, at block 119. If the model and coefficients fail any one of the tests of decision blocks 115–119, the system returns to block 97 to build another model. If the model passes each of the tests of decision blocks 115–119, then the system sets model to "yes" and stores the model, at block 121. After storing the model, the system returns block 97 to build another model. Thus, the system of the present invention continually updates the model.

Figure 7:
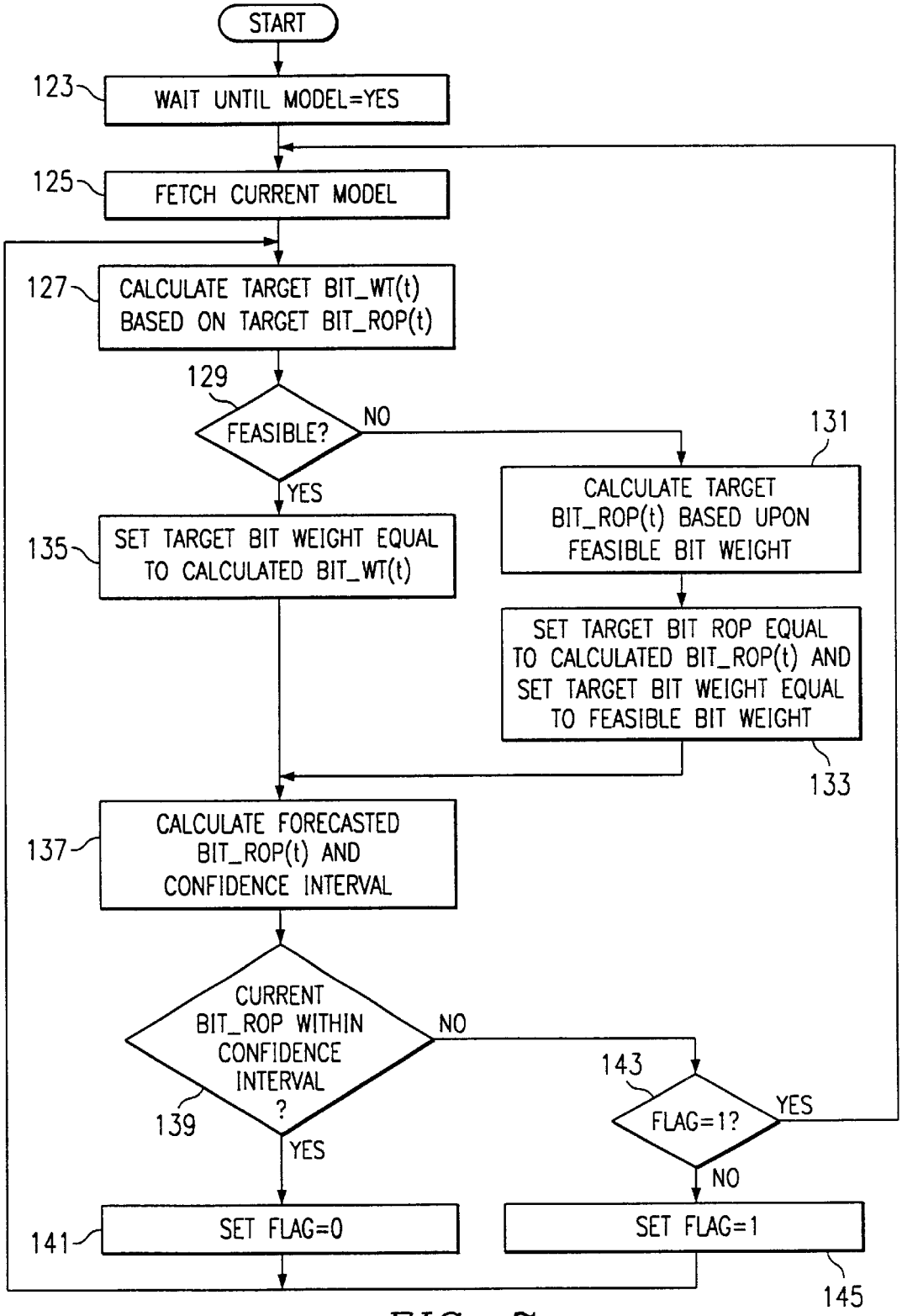
FIG. 7 is a flowchart of rate of penetration optimization according to the present invention.

Referring now to FIG. 7, there is shown a flow chart of penetration optimization according to the present invention. FIG. 7 processing starts when drilling starts. The system waits at block 123 until model is equal to yes. When model is equal to yes, which indicates that a valid model currently exists, then the system fetches the current model, which is an equation of the form of equation (1), at block 125. Then, the system calculates a target bit weight based upon the fetched model, at block 127. Equation (1) may be rearranged as follows:

$$BIT_WT(t)=\frac{BIT_ROP(t)-(\alpha+\beta_1 BIT_ROP(t-1))+\beta_2 BIT_ROP(t-2)}{\beta_3} \quad (2)$$

Target bit weight may thus be calculated by setting BIT_ROP(t) to the target bit rate of penetration and solving equation (2).

The solution of equation (2) produces a bit weight that will bring BIT_ROP(t) immediately to the target bit rate of penetration. The calculated bit weight may be much higher than a feasible value. Accordingly, the system tests, at decision block 133 whether or not the calculated target bit weight is feasible. If not, the system calculates a target BIT_ROP based upon a maximum feasible bit weight, at block 131, by solving equation (1) for the maximum feasible bit weight. Then, the system sets the target BIT_ROP equal to the calculated BIT_ROP(t) and sets the target bit weight equal to the feasible bit weight, at block 133. If, at decision block 129, the calculated target bit weight is feasible, then the system sets the target bit weight equal to the calculated bit weight, at block 135.

Alternatively, the system may compute a steady state target bit weight. In the steady state, BIT_ROP(t) remains constant. Thus, the lagged BIT_ROP values are equal to the current BIT_ROP value. The steady state bit weight BIT_WT may be calculated as follows:

$$BIT_WT = \frac{BIT_ROP(1-(\beta_1+\beta_2))-\alpha}{\beta_3} \quad (3)$$

After completing steps 133 or 135 at FIG. 7, the system calculates a forecasted BIT_ROP(t) and confidence interval at block 137. The forecasted BIT_ROP(t) is calculated by solving equation (1) for the actual current bit weight. The system tests, at decision block 139, if the current BIT_ROP is within the confidence interval. If so, the system sets the flag to zero at block 141 and processing returns to block 127. If, at decision block 139, the current BIT_ROP is not within the confidence interval, then the system tests, at decision block 143 if the flag is set to one. If not, the system sets the flag to one at block 145 and returns to block 127. If, at decision block 143, the flag is set to one, which indicates that the model has failed on two consecutive iterations, the system returns to block 125 to fetch a new current model.

From the foregoing, it may be seen that the present invention is well adapted to overcome the shortcomings of the prior art. The system of the present invention builds a mathematical model of the relationship between weight on bit and rate of penetration for the current drilling environment. The system continuously updates the mathematical model to reflect changes in the drilling environment. The system uses a drilling model to determine a target weight on bit to produce an optimum rate of penetration. The driller attempts to match the actual weight on bit to the target weight on bit.

The system continuously tests the validity of the model by comparing the rate of penetration predicted by the model to the actual measured rate of penetration. If the actual rate of penetration varies from the predicted rate of penetration by more than a selected amount for more than a selected time, the model is no longer valid for the current drilling environment. The system alerts the driller that the drilling environment has changed and fetches the current updated model. The system then computes the target weight on bit based on the updated model.

What is claimed is:

1. A method of optimizing bit rate of penetration while drilling, which comprises the steps of:

substantially continuously determining an optimum drilling control variable value to achieve an optimum bit rate of penetration; and maintaining said drilling control variable at said optimum drilling control variable value.

2. The method as claimed in claim 1, wherein said step of substantially continuously determining an optimum drilling control variable value to achieve an optimum bit rate of penetration includes the steps of:

(a) substantially continuously determining bit rate of penetration and said drilling control variable value while drilling;

(b) periodically computing an optimum drilling control variable value based upon said determined rate of penetration and said determined drilling control variable value; and, (c) repeating steps (a) and (b) while drilling.

3. The method as claimed in claim 2, wherein said step of maintaining said drilling control variable at said optimum drilling control variable value includes the steps of:

displaying a currently determined drilling control variable value to a human driller; and, displaying said optimum drilling control variable value to said human driller to enable said human driller to match said displayed currently determined drilling control variable to said displayed optimum drilling control variable.

4. The method as claimed in claim 2, wherein said step of maintaining said drilling control variable at said optimum drilling control variable value includes the steps of:

inputting a currently determined drilling control variable value to an automatic drilling machine; and, inputting said current optimum drilling control variable value to said automatic drilling machine.

5. The method as claimed in claim 2, wherein said step of substantially continuously determining bit rate of penetration and said drilling control variable value while drilling includes the step of:

making surface measurements of drilling parameter values.

6. The method as claimed in claim 5, wherein said drilling control variable is weight on bit.

7. The method as claimed in claim 6, wherein said step of determining said drilling control variable and bit rate of penetration includes the steps of:

measuring weight on hook;

measuring hook rate of penetration;

computing weight on bit based upon measured weight on hook; and, computing bit rate of penetration based upon measured weight on hook and measured hook rate of penetration.

8. The method as claimed in claim 1, wherein said step of substantially continuously determining an optimum drilling control variable to achieve an optimum bit rate of penetration includes the steps of:

building a mathematical model of bit rate of penetration as a function of drilling control variable value;

substantially continuously updating said mathematical model while drilling; and, computing an optimum drilling control variable value based upon said mathematical model.

9. A method of optimizing bit rate of penetration in drilling operations, which comprises the steps of:

substantially continuously determining bit rate of penetration as function of a drilling control variable value for a set of conditions;

periodically, while drilling, calculating a target drilling control variable value to produce a desired bit rate of penetration for said set of conditions; and, maintaining a current drilling control variable value equal to said target drilling control variable value during drilling.

10. The method as claimed in claim 9, maintaining a current drilling control variable value equal to said target drilling control variable value during drilling includes the steps of:

displaying said current drilling control variable value and said target drilling control variable to a human driller.

11. The method as claimed in claim 10, wherein said drilling control variable is weight on bit.

12. The method as claimed in claim 11, wherein said step of maintaining said current drilling control variable value equal to said target drilling control variable during drilling includes the step of controlling a brake to attempt to match said displayed current bit weight to said displayed target bit weight.

13. The method as claimed in claim 10, wherein said drilling control variable is weight on bit, and said step of maintaining said current drilling control variable equal to said target drilling control variable during drilling includes the step of inputting said target weight on bit to an automatic driller.

14. A method of optimizing bit rate of penetration in drilling operations, which comprises the steps of:

(a) substantially continuously determining weight on bit and bit rate of penetration;

(b) periodically, while drilling, determining an optimum weight on bit to achieve said optimum rate of penetration.

15. The method as claimed in claim 14, including the step of:

(c) maintain weight on bit at said optimum weight on bit while drilling.

16. The method as claimed in claim 15, including the step of repeating steps (a)–(c) while drilling.

17. The method as claimed in claim 14, wherein said step of determining an optimum weight on bit includes the steps of:

periodically computing bit rate of penetration as a function of weight on bit.

18. A drilling system, which comprises:

means for displaying current weight on bit;

means for displaying a target bit weight; and, means for controlling weight on bit so that a driller can attempt to match said displayed current bit weight to said target bit weight.

19. The system as claimed in claim 18, wherein said target bit weight is selected to produce an optimum bit rate of penetration.

20. The system as claimed in claim 18, including:

means for determining said current weight on bit; and, means for determining a current bit rate of penetration.

21. The system as claimed in claim 20, including:

means for determining said target bit weight based upon determined current weights on bit and determined current rates of penetration.

22. A drilling system, which comprises:

means for substantially continuously determining current weight on bit while drilling;

means for substantially continuously determining current bit rate of penetration while drilling; and means for periodically determining a target weight on bit while drilling.

23. The system as claimed in claim 22, including:

means for maintaining current weight on bit equal to said target weight on bit while drilling.

24. The system as claimed in claim 22, wherein said target weight on bit is selected a achieve an optimum bit rate of penetration.

25. A drilling method, which comprises the steps of:

substantially continuously determining current weight on bit while drilling;

substantially continuously determining current bit rate of penetration while drilling; and periodically determining a target weight on bit while drilling based upon determined weights on bit and bit rates of penetration.

26. The method as claimed in claim 25, including the step of:

maintaining current weight on bit equal to said target weight on bit while drilling.

27. The method as claimed in claim 25, wherein said target weight on bit is selected a achieve an optimum bit rate of penetration.

* * * * *